US008672122B2

(12) United States Patent
Liu et al.

(10) Patent No.: US 8,672,122 B2
(45) Date of Patent: Mar. 18, 2014

(54) CARRYING CONTAINER FOLDED FROM A DIE CUT SHEET MATERIAL

(76) Inventors: An-Hsia Liu, Torrance, CA (US); Victor D. Liu, Torrance, CA (US); Alexander D. Liu, Torrance, CA (US); Wen-Shueh M. Liu, Torrance, CA (US)

( * ) Notice: Subject to any disclaimer, the term of this patent is extended or adjusted under 35 U.S.C. 154(b) by 879 days.

(21) Appl. No.: 11/810,158

(22) Filed: Jun. 4, 2007

(65) Prior Publication Data

US 2008/0011621 A1 Jan. 17, 2008

Related U.S. Application Data

(60) Provisional application No. 60/831,164, filed on Jul. 15, 2006.

(51) Int. Cl.
*B65D 75/00* (2006.01)

(52) U.S. Cl.
USPC ..... 206/175; 206/433; 206/193; 229/89

(58) Field of Classification Search
USPC ..... 206/434, 435, 427, 429, 784, 193, 199, 206/162, 171, 200, 140, 180, 189, 175, 194, 206/196, 141, 433, 170, 174; 229/117.12–117.17, 933, 934, 941, 229/114, 186–188, 190–197, 177, 178, 179, 229/180, 911, 910, 87.01, 87.02, 87.04, 229/87.06, 89
See application file for complete search history.

(56) References Cited

U.S. PATENT DOCUMENTS 717,775 A * 1/1903 Single ..... 229/125.41
888,653 A * 5/1908 Potter ..... 383/13
1,983,010 A * 12/1934 Spees ..... 229/117.15
1,985,111 A * 12/1934 Shofer et al. ..... 229/117.05
2,008,443 A * 7/1935 Froehlig ..... 229/117.14
2,074,477 A * 3/1937 Kondolf ..... 206/773
2,107,999 A * 2/1938 Friedel ..... 206/766
2,132,632 A * 10/1938 Kondolf ..... 206/427
2,138,700 A * 11/1938 Hoff ..... 229/204
2,200,813 A * 5/1940 Warren ..... 206/143
2,321,534 A * 6/1943 Warren ..... 206/168
2,345,567 A * 4/1944 Arneson ..... 206/176
2,351,528 A * 6/1944 Lupton ..... 206/195
2,372,351 A * 3/1945 Arneson ..... 206/171
2,384,480 A * 9/1945 Lupton ..... 206/195
2,514,073 A * 7/1950 Karlson ..... 229/126
2,659,524 A * 11/1953 McElwee ..... 206/193
2,698,126 A * 12/1954 Belsinger ..... 229/117.17
3,743,169 A * 7/1973 Person ..... 229/114
4,088,261 A * 5/1978 Osborne ..... 229/125
(Continued)

*Primary Examiner* — Jacob K Ackun
*Assistant Examiner* — Jenine Pagan
(74) *Attorney, Agent, or Firm* — Raymond Y. Chan; David and Raymond Patent Firm

(57) ABSTRACT

A carrying container for bottles includes a container body and a packaging reinforcing arrangement. The container body, which is made of a one-piece panel structure having a plurality of folding lines provided thereon, includes a bottom wall, a top wall, a front wall, a rear wall, and two side walls to form a substantially cubic structure of the container and to define a receiving cavity. The packaging reinforcing arrangement includes two reinforcing walls integrally extended from two side edges of the bottom wall to the two side walls respectively, and supported within the receiving cavity at a position that a front reinforcing edge and a rear reinforcing edge of each of the reinforcing walls are biasing against inner surfaces of the front and rear walls of the container body for effectively resisting an external impact force.

16 Claims, 10 Drawing Sheets

(56) References Cited

U.S. PATENT DOCUMENTS

| | | | | | |
|---|---|---|---|---|---|
| 4,096,985 | A | * | 6/1978 | Wood | 206/427 |
| 4,238,069 | A | * | 12/1980 | Morris, Jr. | 229/117.15 |
| 4,558,815 | A | * | 12/1985 | Wischusen, III | 229/112 |
| 4,934,586 | A | * | 6/1990 | Kadien | 229/117.14 |
| 5,042,715 | A | * | 8/1991 | McNeill | 229/117.15 |
| 5,284,294 | A | * | 2/1994 | Floyd | 229/179 |
| D393,422 | S | * | 4/1998 | Pecher | D9/433 |
| 5,853,121 | A | * | 12/1998 | Francisco | 229/188 |
| 6,059,179 | A | * | 5/2000 | Giampapa | 229/103 |
| 6,253,993 | B1 | * | 7/2001 | Lloyd et al. | 229/117.3 |
| 6,736,309 | B1 | * | 5/2004 | Westerman et al. | 229/117.05 |
| 6,837,420 | B2 | * | 1/2005 | Westerman et al. | 229/117.15 |

* cited by examiner

CARRYING CONTAINER FOLDED FROM A DIE CUT SHEET MATERIAL

CROSS REFERENCE OF RELATED APPLICATION

This is a non-provisional application for a provisional application having an application number of 60/831,164 and a filing date of Jul. 15, 2006.

BACKGROUND OF THE PRESENT INVENTION

1. Field of Invention

The present invention relates to a container, and more particularly to a carrying container comprising a packaging reinforcing arrangement which is capable of substantially enhancing a structural strength and integrity of the carrying container.

2. Description of Related Arts

A conventional carrying container, such as a conventional CARTON, usually comprises a container body having a front panel, a rear panel, a top panel, a base panel, and two side panels for forming a receiving cavity within these panels for receiving a predetermined object, such as a wine bottle. All these panels are usually made of die cut sheet materials which make the carrying container easy to assemble, and light to carry. However, when the carrying container has been utilized for carrying the object, it is easy to be recycled by its structural configuration. In other words, even though the conventional carrying container is made of CARTON, the conventional carrying container must be incorporated with other materials, such as gluing element, to affix the front panel, rear panel, top panel, base panel and side panels to form a box structure. Therefore, the folding structure of the conventional carrying container has a relatively weak loading structure to support the object.

There are several disadvantages in association with this kind of carrying container. First, virtually all conventional containers are manufactured by die cutting sheet materials which is divided into several portions and flaps, wherein specific portions or flaps formed on the sheet materials are folded and attached with each other to form a three-dimensional (and usually cubic) carrying container. The problem with this kind of conventional arts is that the base panel is usually formed by folding a plurality of flaps so that the base panel is actually made up by the flaps interlocking with each other for supporting the object within the receiving cavity. Very often, therefore, the structural strength of the base panel is usually not strong enough to such an extent that when the carrying container is subject to external impact, or when the object carried within the carrying container is fairly heavy, the base panel may break and cause the object to fall from the receiving cavity. This scenario is further aggravated when the carrying container is utilized in an environment in which the humidity is high, such as when the carrying container is utilized in a rainy day.

Second, even when the base panel does not suffer from structural instability, the entire structure of the carrying container may be so vulnerable to external impact that the container may collapse rather easily. In such scenario, the objects stored within the receiving cavity cannot be properly protected and this disadvantage may cause undue damage to the objects carried by the conventional carrying container.

Third, some of the conventional carrying containers require some sorts of adhesive equipments, such as tapes, for enhancing the structural strength of the carrying containers. For example, tapes may be utilized for sealing a top opening or any opening at the bottom panel of the conventional carrying containers for maintaining a desirable structural integrity thereof. This is troublesome from the point of view of the users, as well as from the point of view of those who wish to disassemble the carrying containers for consuming the objects within the receiving cavity.

Fourth, many conventional carrying containers do not have handles. For those which have handles, they are usually embodied as a plurality of handling members extended from the top panel, in which the handling members have two aligned handle slots formed thereon respectively for allowing a user to grip on the handling members so as to provide a handle for the user to carry the entire carrying containers by the handle slots. The problem with this design is that in the vicinity of the handling slots, the carrying container has less structural strength than any other part thereof so that the relevant area (i.e. area in the vicinity of the handling slots) may break very easily, especially when the carrying container is carrying heavy objects.

SUMMARY OF THE PRESENT INVENTION

A main object of the present invention is to provide a carrying container which is conveniently folded from die cut sheet materials for forming a carrying container comprising a packaging reinforcing arrangement, wherein the packaging reinforcing arrangement which is capable of substantially enhancing a structural strength and integrity of the carrying container.

Another object of the present invention is to provide a carrying container comprising a container body for supporting the objects stored within the carrying container, wherein the container body comprises a bottom wall which forms a one-piece panel structure for maximizing the structural strength of the container body.

Another object of the present invention is to provide a carrying container having double sidewall structure for resisting external impact from two sides of the carrying container.

Another object of the present invention is to provide a carrying container which does not require additional adhesive elements for carrying the objects within the container body. In other words, the structural integrity and strength of the present invention will not be jeopardized by the above-mentioned shortcomings for conventional carrying containers. Therefore, no adhesive gluing operation is involved in the present invention to form the carrying container so as to enhance the overall loading structure thereof.

Another object of the present invention is to provide a carrying container which comprises a handling arrangement for facilitating easy carrying of the carrying container, wherein the handling arrangement does not jeopardize the overall structural strength of the carrying container. In other words, the handling arrangement not only integrally forms with the carrying container to minimize the extra material required forming the handle of the carrying container but also enhances the loading structure of the carrying container.

Another object of the present invention is to provide a method of manufacturing a carrying container by conveniently folding a die cut sheet materials into a three-dimensional structure. Accordingly, the carrying container of the present invention is approximately 35% less material in glue-free manner used in comparison with the conventional carrying container which needs gluing material for box-formation.

Accordingly, in order to accomplish the above objects, the present invention provides a carrying container for one or more bottles, comprising:

a container body, made of a one-piece panel structure having a plurality of folding lines provided thereon, comprising a bottom wall, a top wall, a front wall integrally extended from a front peripheral edge of the top wall to a front peripheral edge of the bottom wall, a rear wall, which is identical to the front wall, integrally extended from a rear peripheral edge of the top wall to a rear peripheral edge of the bottom wall, and two side walls extended from two sides peripheral edges of the front wall to two side peripheral edges of the bottom walls respectively to form a substantially cubic structure of the container and to define a receiving cavity within the top wall, the bottom wall, the front wall, the rear walls and the two side walls for holding the bottle in the receiving cavity; and a packaging reinforcing arrangement which comprises two reinforcing walls which are integrally extended from two side edges of the bottom wall to the two side walls respectively and are supported within the receiving cavity at a position that a front reinforcing edge and a rear reinforcing edge of each of the reinforcing walls are biasing against inner surfaces of the front and rear walls of the container body for effectively resisting an external impact force exerted from the front and rear walls of the container to the bottle, such that the two reinforcing walls substantially enhance a structural strength of a bottom portion of the container body and prevent collapse of the carrying container.

These and other objectives, features, and advantages of the present invention will become apparent from the following detailed description, the accompanying drawings, and the appended claims.

DETAILED DESCRIPTION OF THE PREFERRED EMBODIMENT

Figure 1:
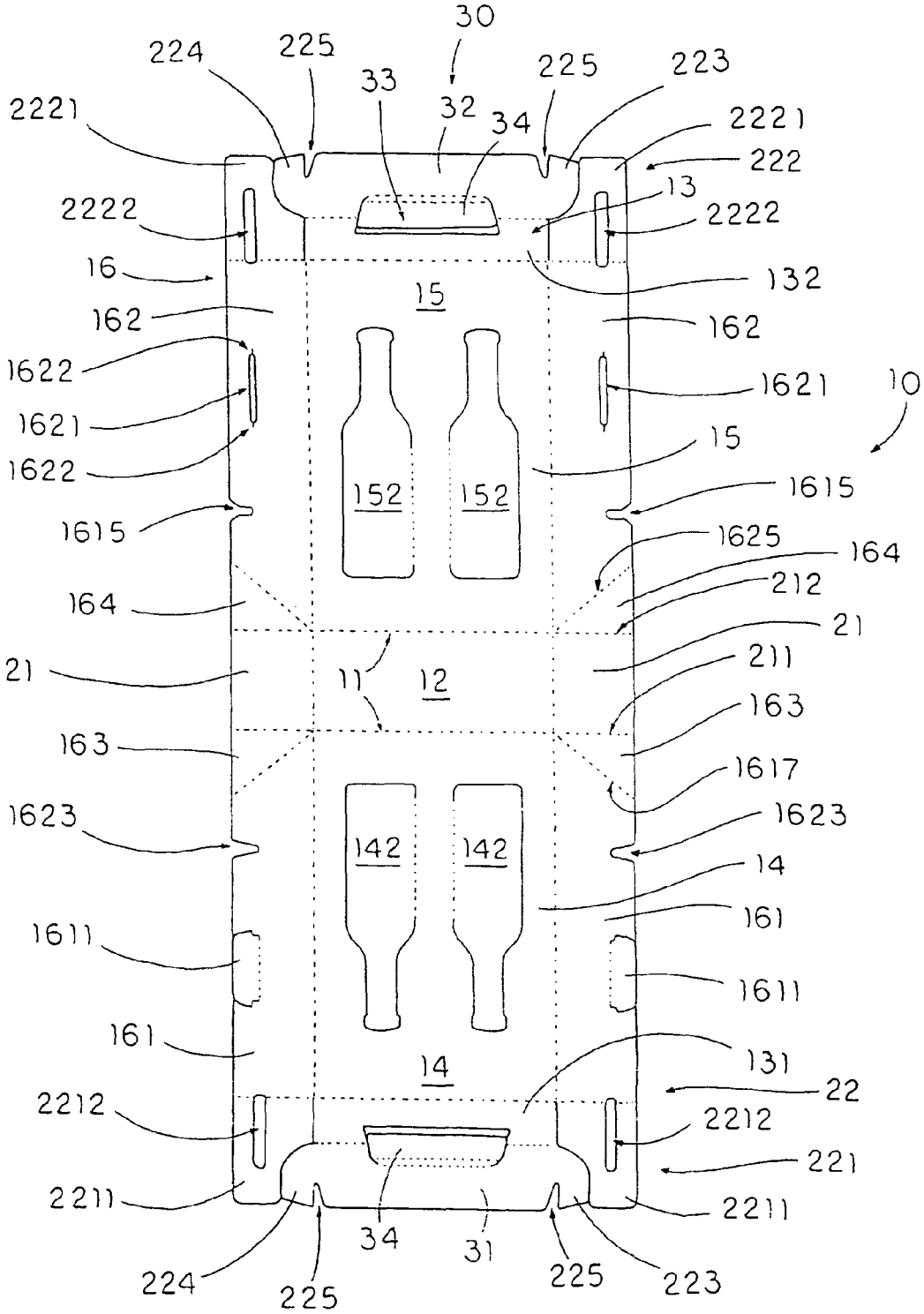
FIG. 1 is a development view of a carrying container according to a preferred embodiment of the present invention.
Figure 2:
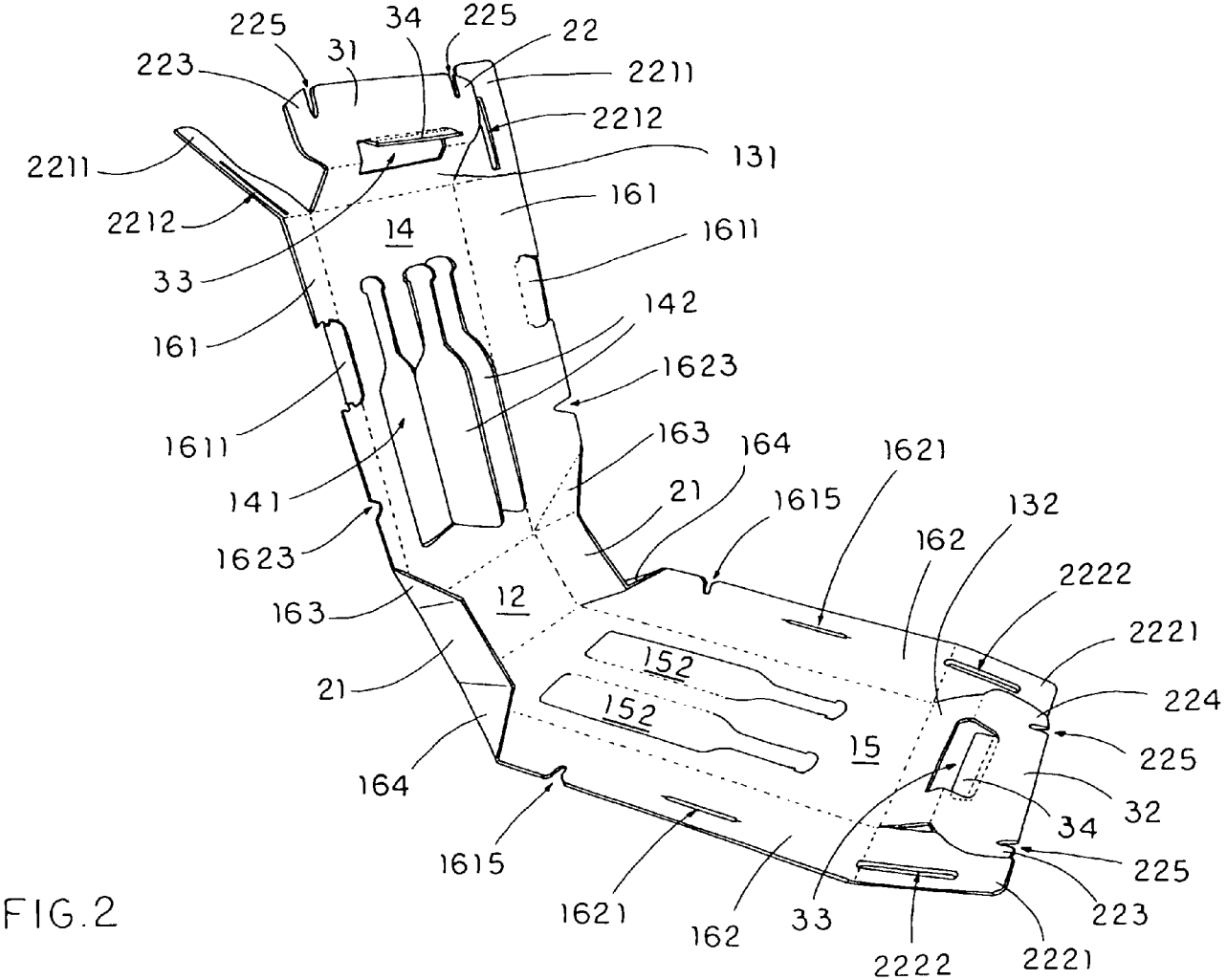
FIG. 2 is a perspective view of the carrying container according to the above preferred embodiment of the present invention.
Figure 3:
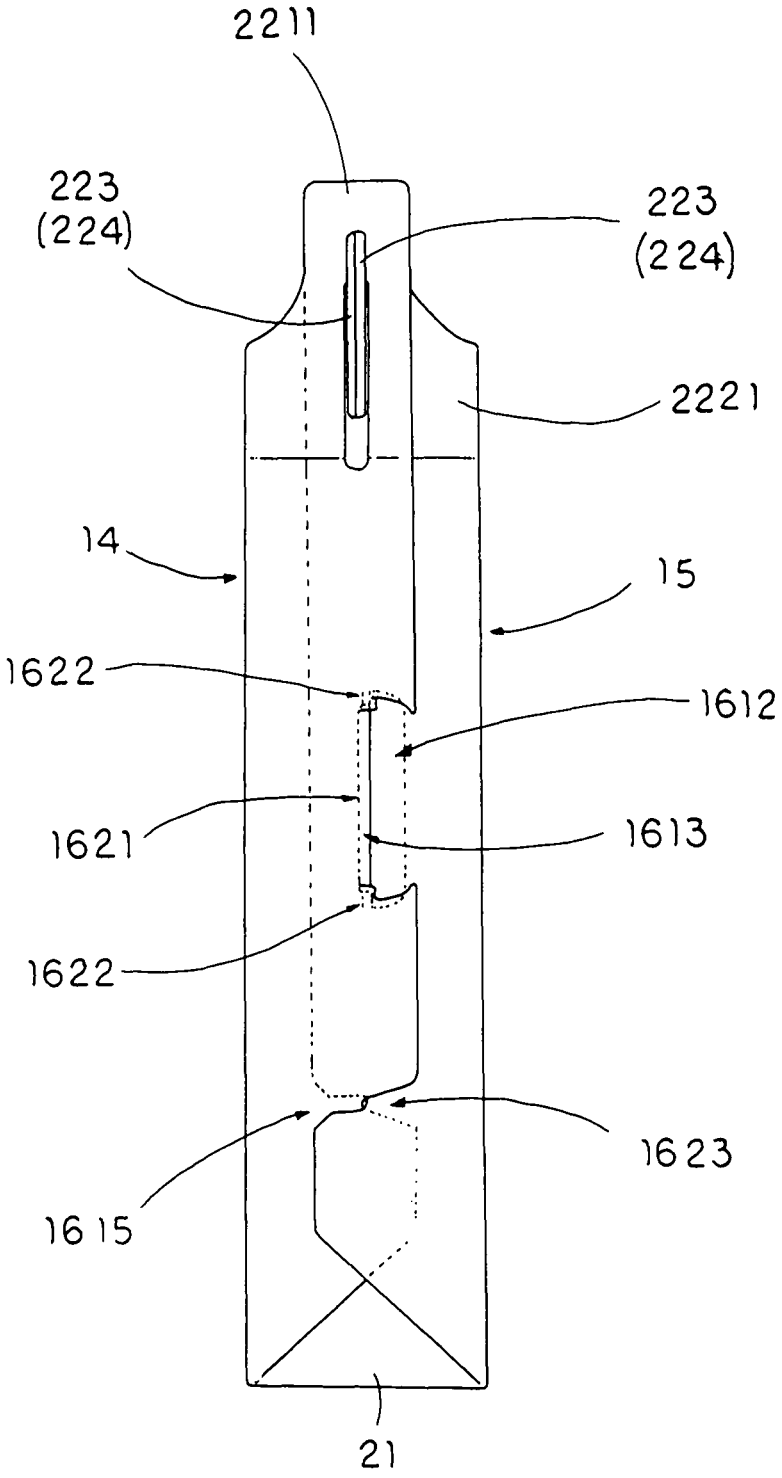
FIG. 3 is a schematic view of the side panels according to the above preferred embodiment of the present invention.

Referring to FIG. 1 to FIG. 3 of the drawings, a carrying container for at least an object, such as two wine bottles 70, according to a preferred embodiment of the present invention is illustrated, in which the carrying container comprises a container body 10, and a packaging reinforcing arrangement 20.

The container body 10, which is made of a one-piece panel structure having a plurality of folding lines 11 provided thereon, comprises a bottom wall 12, a top wall 13, a front wall 14 integrally extended from a front peripheral edge of the top wall 13 to a front peripheral edge of the bottom wall 12, a rear wall 15, which is similar to the front wall 14, integrally extended from a rear peripheral edge of the top wall 13 to a rear peripheral edge of the bottom wall 12, and two side walls 16 extended from two sides peripheral edges of the front wall 14 to two side peripheral edges of the bottom walls 12 respectively to form a substantially cubic structure of the container and to define a receiving cavity 17 within the top wall 13, the bottom wall 12, the front wall 14, the rear wall 15 and the two side walls 16 for holding the bottles 70 in the receiving cavity 17. As shown in FIG. 1, the folding lines 11 are illustrated as the dotted lines in the figure. Preferably, the rear wall 15 is constructed identical to the front wall 14.

On the other hand, the packaging reinforcing arrangement 20 comprises two reinforcing walls 21 which are integrally extended from two side edges of the bottom wall 12 to the two side walls 16 respectively and are supported within the receiving cavity 17 at a position that a front reinforcing edge 211 and a rear reinforcing edge 212 of each of the reinforcing walls 21 are biasing against inner surfaces of the front and rear walls 14, 15 of the container body 10 for effectively resisting an external impact force exerted from the front and rear walls 14, 15 of the container body 10 to the bottles 70, such that the two reinforcing walls 21 substantially enhance a structural strength of a bottom portion of the container body 10 and prevent collapse of the carrying container.

According to the preferred embodiment of the present invention, the carrying container is made of die cut sheet material which is preferably embodied as a thin and flat sheet material having a semi-rigid material strength. For example, the die cut sheet material can be a fiberboard, a thin plastic sheet or a thin metal sheet, which can be punched, perforated, scored, trimmed and folded easily.

The front wall 14 has a plurality of front display openings 141 spacedly formed thereon for communicating an exterior of the container body 10 with the receiving cavity 17, wherein the front wall 14 forms as a flat and rectangular front panel folded from the sheet material. On the other hand, the rear wall 15 has a plurality of rear display openings 151 spacedly formed thereon for communicating an exterior of the container body 10 with the receiving cavity 17. Similar to the front wall 14, the rear wall 15 is embodied as a flat and rectangular rear panel folded from the same sheet material as mentioned above. Moreover, each of the front display openings 141 is aligned with the corresponding rear display opening 151 such that a user is able to observe the bottles 70 from either the front display openings 141 or the rear display openings 151.

In order to enhance the displaying function of the rear openings 151, each of the rear display openings 151 is shaped and sized to correspond with the bottles stored by the corresponding rear display opening 151. Each of the rear displaying openings 151 is formed by cutting the rear panel along the peripheral edges thereof to form a corresponding number of rear partitioning flaps 152 integrally and foldably extended from a rear hinge portion 153 of the corresponding peripheral edge which is not being cut. In other words, the rear wall 15 further comprises a plurality of rear partitioning flaps 152 integrally and foldably extended from rear hinge portions 153 of the peripheral edges of the rear openings 151 respectively, wherein each of the rear partitioning flaps 152 is adapted to fold inwardly into the receiving compartment 17 to divide the receiving compartment 17 into a corresponding number of storage partitions between each two rear partitioning flaps 152.

Similarly, each of the front displaying openings 141 is formed by cutting the front panel along the peripheral edges thereof to form a corresponding number of front partitioning flaps 142 integrally and foldably extended from a front hinge portion 143 of the corresponding peripheral edge which is not being cut. In other words, the front wall 14 further comprises a plurality of front partitioning flaps 142 integrally and foldably extended from front hinge portions 143 of the peripheral edges of the front openings 141 respectively, wherein each of the front partitioning flaps 142 is adapted to inwardly fold into the receiving compartment 17 to overlap with the rear partitioning flaps 152 for strengthening portioning between each two storage partitions and to enhance protection for each storage partition from external impact. In other words, the front and rear partitioning flaps 142, 152 constitute a double wall structure for dividing the storage partitions by overlapping the front and rear partitioning flaps 142, 152.

Thus, the front panel and the rear panel are preferably flat, rectangular or irregular shaped. There are preferably used as panels to shield and enclose the product in between. They preferably have a few hinged cut out (for forming the front and the rear hinge portion 143, 153) to be pushed into the body of the carrying container and function as the partitions for cushion or a few cut out pieces from the panels to place inside of the carrying container function as the individual partition for cushion.

The bottom wall 12 comprises a bottom panel which is preferably a flat part of the carrying container. It is preferably used to support the product weight. The bottom panel is preferably surrounded by the front wall 14, rear wall 15, and the two side walls 16.

According to the preferred embodiment of the present invention, each of the sidewalls 16 comprises a first and a second side panel 161, 162 integrally and foldably extended from the front wall 14 and the rear wall 15 respectively, wherein the first side panel 161 is arranged to detachably engage with the second side panel 162 for forming a rigid double wall structure for each of the sidewalls 16. More specifically, each of the first side panels 161 comprises a locking flap 1611 foldably provided at an outer side edge portion thereof, whereas each of the second side panels 162 further has a through locking slot 1621 formed thereon to align with the corresponding locking flap 1611 which is then adapted to detachably engage with that locking slot 1621 for detachably engaging the first side panel 161 with the second side panel 162.

Figure 4:
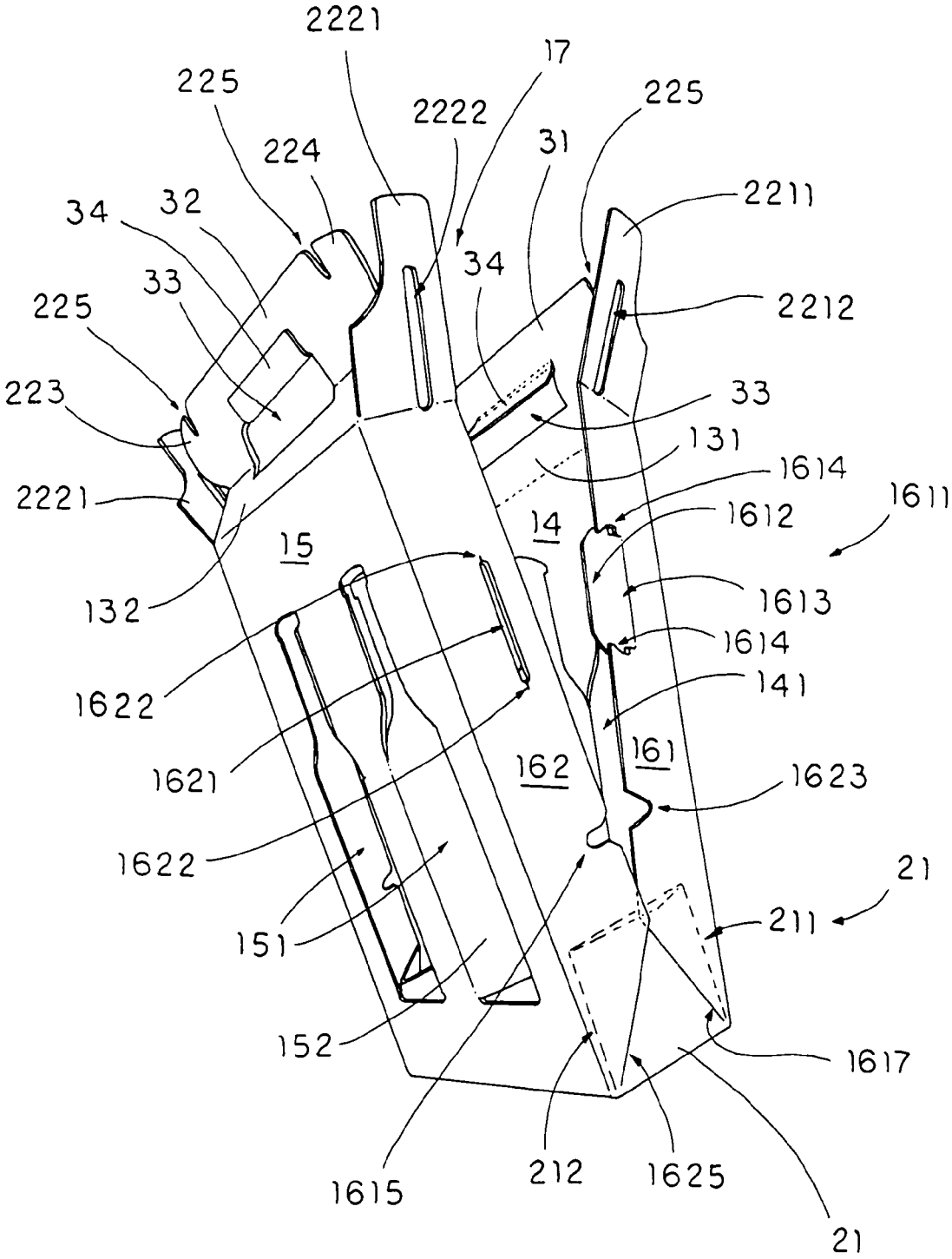
FIG. 4 is a perspective view of the side panels according to the above preferred embodiment of the present invention.

Referring to FIG. 4 of the drawings, it is important to mention that each of the second side panels 162 further has two holding silts 1622 extended from two ends of the locking slots 1621, whereas for each of the first side panels 161, the locking flap 1611 has a main locking portion 1612 and a contracted portion 1613, having a width smaller than a width of the main locking portion 1612, integrally extended from the front wall 14 to define two L-shaped locking shoulders 1614 between the main locking portion 1612 and the contracted portion 1613 at two sides thereof respectively, wherein the L-shaped locking shoulders 1614 is arranged to fittedly and detachably engage with the two holding slits 1622 respectively when the locking flap 1611 is detachably engaged with the corresponding locking slot 1621.

In other words, one of the first side panels 161 can be embodied as a front right side panel which engages with the second side panel 162 embodied as a rear right side panel by engaging the front right side locking flap 1611 lock into the rear right locking slot 1621 and blocking by the rear right holding slits 1622. Similarly, one of the first side panels 161 can be embodied as a front left side panel that engages with another second side panel 162 embodied as a rear left side panel by letting the front left side locking flap 1611 lock into the corresponding rear left locking slot 1621 and blocking by the corresponding rear left holding slits 1622.

Furthermore, the first and the second side panels 161, 162 further have a first and a second interlocking slot 1615, 1623 formed on the first and the second side panels 161, 162 respectively to define first and second interlocking edges 1616, 1624 as side edges of the first and the second interlocking slots 1615, 1623 respectively, wherein when the first and the second side panels 161, 162 are engaged with each other, the first and the second interlocking slot 1615, 1623 are interlocked with each other to further enhance a secure engagement between the first and the second side panels 161, 162.

It is worth mentioning that each of the first side panel 161 and the second side panel 162 has a slanted bottom edge 1617, 1625 such that when the first side panel 161 is detachable engaged with the second side panel 162, the slanted bottom edges 1617, 1625 are arranged to overlap with an outer surface of the corresponding reinforcing wall 21. Each of the side walls 16 further comprises a first and a second triangular panels 163, 164, wherein the first triangular panel is integrally extended between the slanted bottom edge 1617 of the first side panel 161 to the front reinforcing edge 211 of the corresponding reinforcing wall 21, and that the second triangular panels 164 is integrally extended between the slanted bottom edge 1625 of the second side panel 162 to the rear reinforcing edge 212 of the corresponding reinforcing wall 21 at the corresponding side wall 16.

Thus, in order words, the first triangular panel 163 is embodied as a front right triangle piece which is a thin piece of the sheet material for integrally connecting the first side panel 161 with the reinforcing wall 21. Similarly, the second triangular panel 164 is embodied as a rear right triangle piece for integrally connecting between the second side panel 162 and the reinforcing wall 21.

Referring to FIGS. 1 to 5 of the drawings, the carrying container further comprises a handling arrangement 30 extended from the top wall 13 of the container body 10 to facilitate easy carrying of the carrying container. More specifically, the top wall 13 of the container body 10 comprises a first and a second top panel 131, 132 integrally extended from a top edge of the front and the rear wall 14, 15 respectively, wherein the handling arrangement 30 comprises a first and a second holding flaps 31, 32 integrally extended from the top edges of the first and the second top panels 131, 132 respectively for normally enclosing the receiving cavity 17 from the top side of the container body 10, and allowing a user of the present invention to grip on the holding flaps 31, 32 so as to carry the carrying container in a convenient manner.

Figure 5:
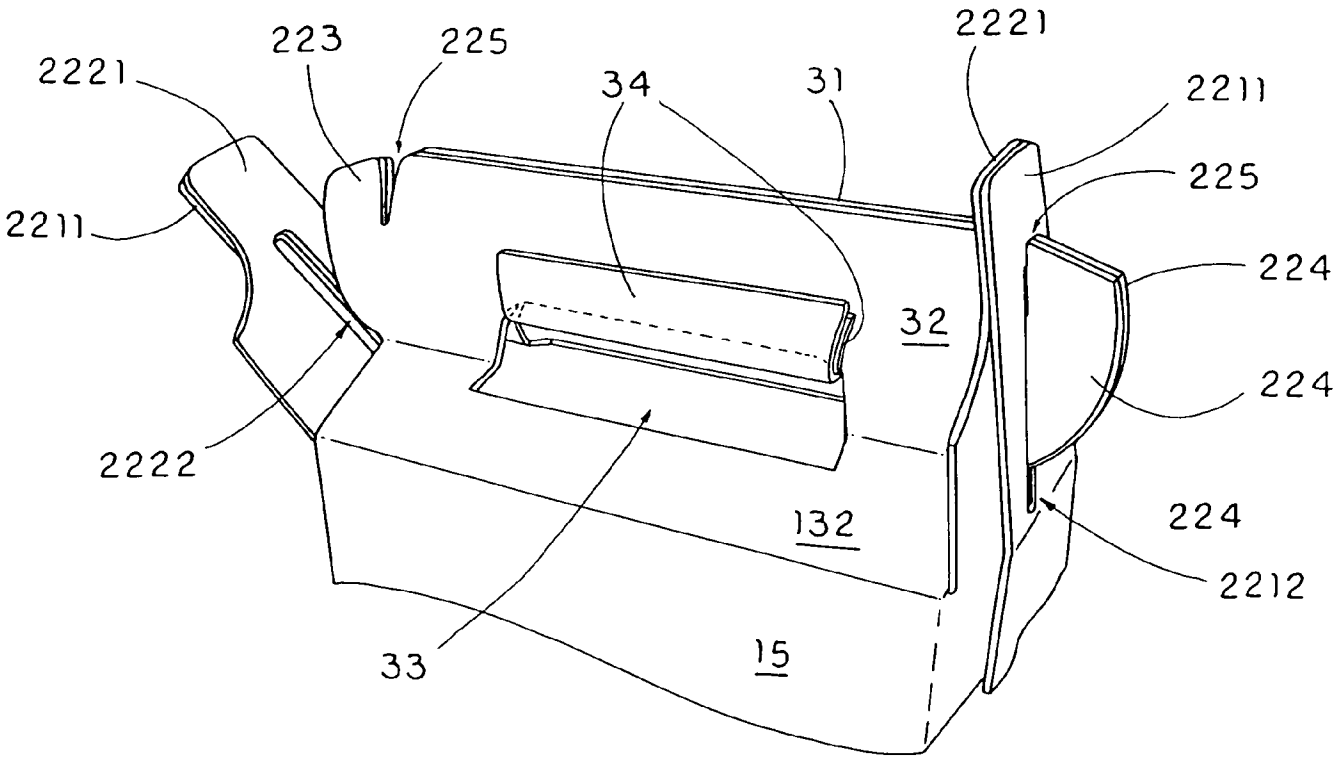
FIG. 5 is a schematic diagram of a handling arrangement according to the above preferred embodiment of the present invention.

The handling arrangement 30 further has a plurality of handling slots 33 formed on the first and the second holding flaps 31, 32 respectively for allowing a user to grip thereon through the handling slots 33. Referring to FIG. 5 of the drawings, each of the handling slots 33 is aligned with each other and is elongated in shape for fitting a width of the user's hand. In order to optimize the carrying comfort of the present invention, the handling arrangement 30 further comprises two holder pads 34 integrally extended from top edges of the handling slots 33 of the first and second holding flaps 31, 32, wherein the holder pads 34 are arranged to extend through the handling slots 33 to partially overlap with an outer surface of the second handing flap 32 so as to embed the top edges of both of the handling slots 33, in such a manner that when a user is carrying the carrying container by the first and the second holding flaps 31, 32, the user's hand is adapted to grip on the holding flaps 31, 32 that the holding flaps 31, 32 are cushioned by the holder pads 34. Therefore, the user's comfort is maximized when he or she is holding the carrying container with the help of the handling arrangement 30. In other words, the holder pads 34 are integrally extended from the top edges of the handling slots 33 of the first and second holding flaps 31 to foldably overlap with the second holding flap 32 with the two holder pads 34 and the first holding flap 31 so as to form a quad-wall structure to ensure the receiving cavity 17 being enclosed when the carrying container is being carried. It is worth to mention that the first and the second holding flaps 31, 32 and the holder pads 34 overlappingly form the handle portion of the carrying container to increase the thickness and the strength thereof and to gain the holding surfaces stronger. Therefore, the handle structure is easier for the user to handle and reduces the uncomfortable cutting feeling on the fingers. It is worth to mention that the two holder pads 34 are integrally extended from the top edges of the handling slots 33 of the first and second holding flaps 31, 32 such that when the holder pads 34 are folded to overlap with the second holding flap 32 through the handling slot 33 thereof, the handle of the container body 10 forms a quad-wall structure that is stronger to avoid breakage and thicker to save the cutting feeling.

Referring to FIG. 1 to FIG. 3 of the drawings, the packaging reinforcing arrangement 20 further comprises a weight support assembly 22 extended from the top wall 13 of the container body 10 to facilitate even distribution of loading along the container body 10 via the bottom wall 12, the top wall 13, the front wall 14, the rear wall 15, and the two side walls 16 so as to allow effective withstanding of loading by the container body 10. The weight support assembly 22 comprises a first and a second hanging flaps 221, 222 integrally and foldably extended from top edges of the side walls 16 respectively, and a plurality of hanging ears 223, 224 integrally and outwardly extended from two sides of each of the holding flaps 31, 32 to define a corresponding number of V-shaped notches 225 on each of the holding flaps 31, 32.

According to the preferred embodiment of the present invention, each of the first and the second hanging flaps 221, 222 comprises two flap panels 2211, 2221 integrally and upwardly extended from top edges of each of the first and the second side panels 161, 162 of the corresponding side wall 16 to substantially align with each other and engage with the first and the second hanging ears 223, 224. More specifically, each of the flap panels 2211, 2221 has an elongated weight loading slot 2212, 2222 formed thereon, wherein the flap panels 2211, 2221 are folded in such manner that top peripheral edges of the weight loading slots 2212, 2222 are arranged to engage with the corresponding supporting notches 225 so as to withstand the loading from the products carried within the receiving cavity 17.

The hanging ears 223, 224 are preferably an irregular shaped, rounded flat piece extended and enlarged outwardly though the supporting notches 225 of the hanging flaps 221, 222. Its is preferable that the two right top hanging flaps 221 are hanging together on the two right side hanging ears 223 and two left top hanging flaps 222 are hanging together on the two left side hanging ears 224.

The loading (i.e. the weight from the objects—the bottles 70) is preferably carried evenly by tucking a pair of right side hanging ears 223 into the pair of right side supporting notch 225 on the right side hanging flap 221 and by tucking a pair of left side hanging ear 224 into the pair of left supporting notch 225 on the left side hanging flap 222. The durability of the hanging ears 223, 224 is preferably strengthened by extending the ear size outwardly and spaced away form the corresponding supporting notch 225 to avoid the stress concentration caused by the heavy load on the holding flaps 31, 32.

It is worth mentioning that a distance between each of the supporting notches 225 and the corresponding hanging ear 223 (224) could be optimally maximized so as to maximize the loading to which the carrying container is capable of withstanding without causing unwanted breakage of the hanging ears 223, 224. The purpose of the extension of the hanging ears 223, 224 outwardly is to space away the supporting notch 225 from the handling slot 33 to avoid breakage and tearing of the first and second holding flaps 31, 32. Usually, it causes by stress concentration on the supporting notch 225 and extended to the handling slot 33. In the mean time, the handling slot 33 can be widened to accept larger hand. Moreover, since the supporting notches 225 are interlocked with the weight loading slots 2212, 2222, the heavier the loading, the tighter the interlocking between the supporting notches 225 and the weight loading slots 2212, 2222. Preferably, a distance between the two pairs of the supporting notches 225 is the same as a distance between the two side walls 16 of the container body 10, i.e. the width of the container body 10.

It is worth to mention that since the bottom wall 12 is arranged to support the weight of the bottles 70 as the downward loading force, the front and rear walls 14, 15 are adapted to evenly distribute the downward loading force by integrally extending the front and rear walls 14, 15 from the bottom wall 12. In addition, once the first and second side panels 161, 162 are locked with each other, the first and second side panels 161, 162 not only evenly distributes the downward loading force from the bottom wall 12 to rigidly support the bottles 70 but also forms a rigid double wall structure for each of the sidewalls 16 of the container body 10 to retain the container body 10 in rigid box-shape structure. Furthermore, when the container body 10 is carried by the user via the handling arrangement 30, the upward carrying force can be evenly distributed through the container body 10. It is because when the user lifts up the container body 10, the upward carrying force is applied at the first and second holding flaps 31, 32 to the front and rear walls 14, 15 through the first and second top panels 131, 132 respectively. The upward carrying force is also evenly distributed to the sidewalls 16 through the weight support assembly 22. Therefore, having the above mentioned interlocking one-piece structure, the container body 10 is adapted to support the bottles 70 without distorting the loading structure of the carrying container. In other words, the present invention provides a 3-dimensional reinforcement to evenly distribute the weight of the bottles 70 through X, Y, and Z axes of the container body 10 through the bottom wall 12, the front and rear walls 14, 15, the sidewalls 16, and the top wall 13.

In operation, use a multiple cavity steel rule die board, to die cut a sheet material with a steel rule die with indentation lines, perforation lines, flanges, cutting lines, and punched holes according to the design of this carrying container.

Figure 6:
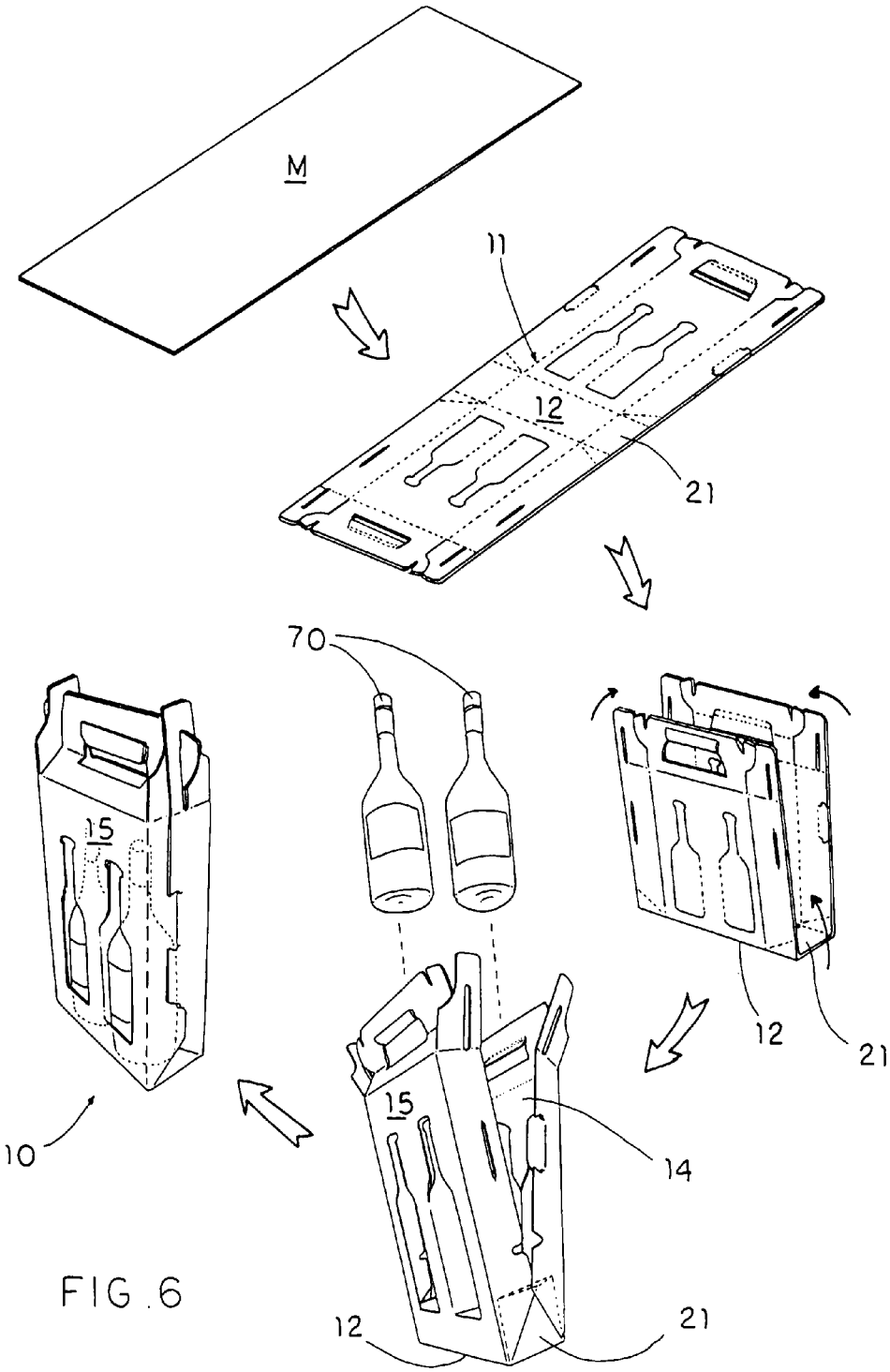
FIG. 6 is a method of manufacturing a carrying container according to the above preferred embodiment of the present invention.

Referring to FIGS. 1 to 6 of the drawings, a method of manufacturing a carrying container according to a preferred embodiment of the present invention is illustrated, in which the method comprises the steps of:

(a) die-cutting a sheet material M into a predetermined shape having a plurality of folding lines 11 provided thereon, wherein more than one sheet materials M can be cut at the same time;

(b) dividing the sheet materials into fifteen folding portions by the folding lines 11, wherein the twenty two portions include a front wall portion, a rear wall portion, four side panel portions, two reinforcing walls portions, four triangular panel portions, two handling portions, four hanging flap portions and four partitioning flap portions;

(c) forming the locking flap 1611, the locking slot 1621 and the interlocking slots 1615, 1623 on the side panel portions of the sheet material;

(d) inwardly folding the sheet materials along two folding lines 50 to form the bottom wall 12, the front wall 14, the rear wall 15, the top wall 13, and two reinforcing walls 21 upwardly extended from two outer sides of the bottom wall 12, wherein the first and the second triangular panels 163, 164 are folded to overlap outside on the two reinforcing walls 21;

(e) inwardly folding two pairs of the four side panel portions to form the two side walls 16 extended between the front wall 14 and the rear wall 15, wherein the locking flap 1611 is detachably engaged with the locking slot 1621 on both side panels, while the interlocking slots 1615, 1623 are interlocked with each other to strengthen a structural integrity and durability of the side walls 16 and to avoid the separation of the locking flaps 1611 from the locking slot 1621, in addition, the interlocking of the interlocking slots 1615, 1623, the locking flap 1611, and the locking slot 1621 further adding the vertical strength and horizontal strength of the 3-dimensional engagements;

(f) folding the handling portions and the hanging flap portions towards each other to fold a complete carrying container of the present invention; and (g) inwardly folding the partitioning portions to form the front and the rear display openings 141, 151. Referring to FIGS. 5 and 6, the user is able to interlock the handling portion by engage the holder pad 34 through the handling slots 33 that overlaps with the first and second holding flaps 31, 32 and holder pad 34. Then, the user is able to engage the pair of hanging flaps 221, 222 threaded through the weight loading slots 2212, 2222 simultaneously on the V-shaped supporting notches 225 to complete the carrying container of the present invention.

Figure 7:
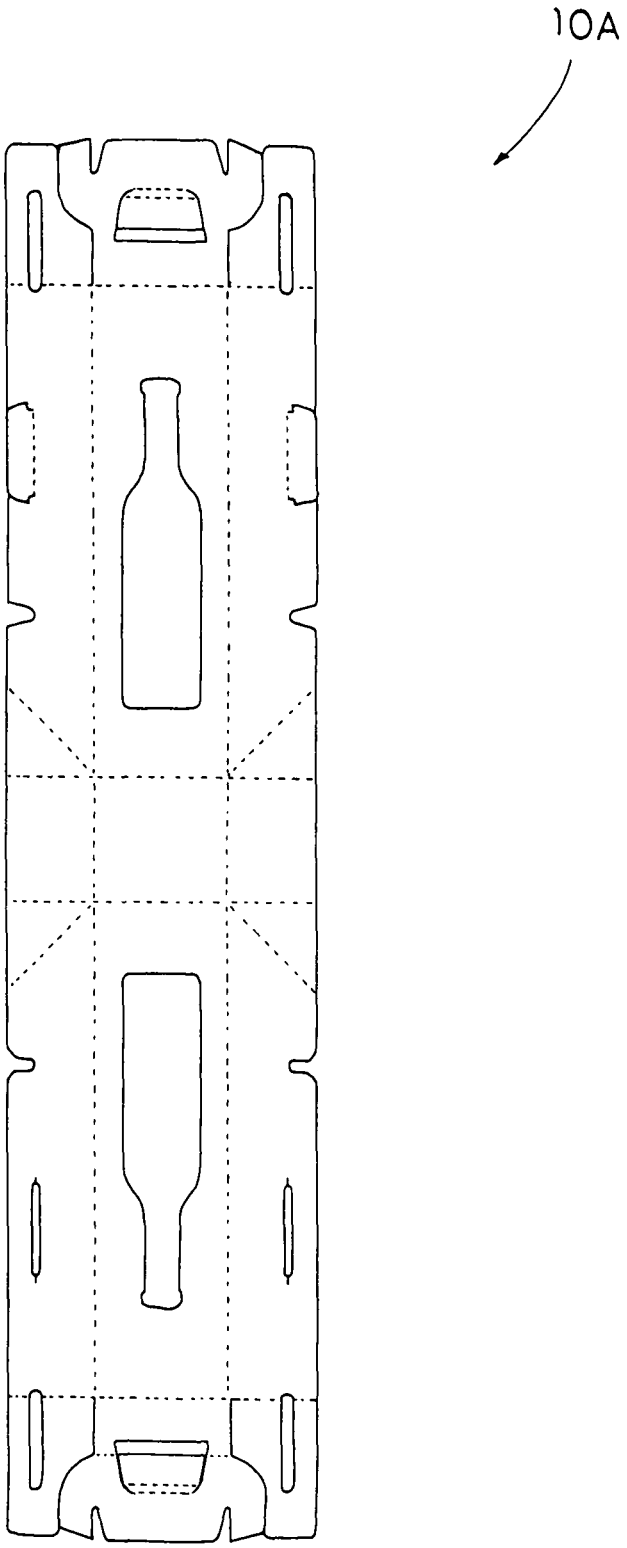
FIG. 7 is a schematic view of the carrying container according to the above preferred embodiment of the present invention, illustrating that the carrying container is adapted to carry one bottle.
Figure 8:
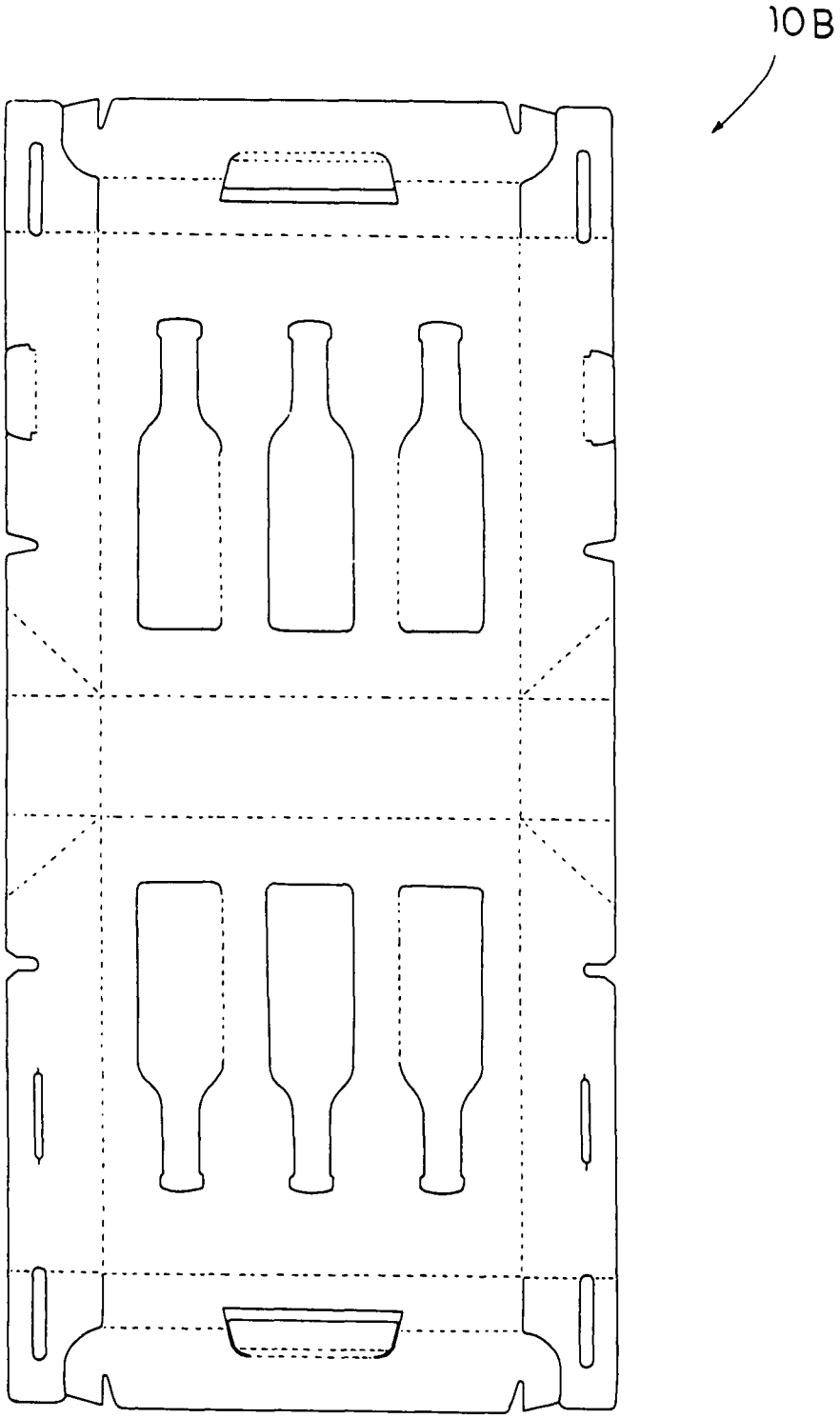
FIG. 8 is a schematic view of the carrying container according to the above preferred embodiment of the present invention, illustrating that the carrying container is adapted to carry three bottles.
Figure 9:
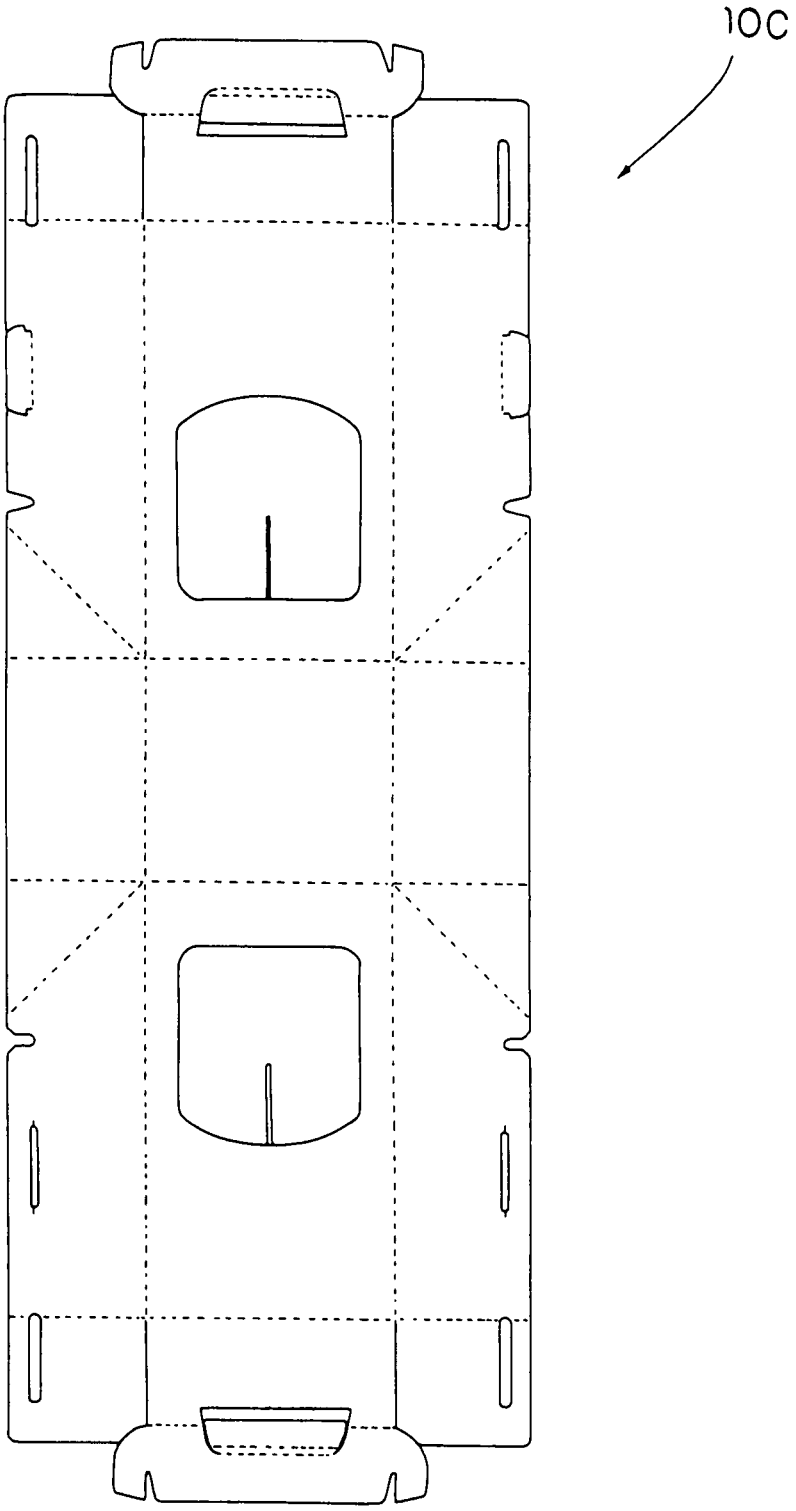
FIG. 9 is a schematic view of the carrying container according to the above preferred embodiment of the present invention, illustrating that the carrying container is adapted to carry four bottles in array.
Figure 10:
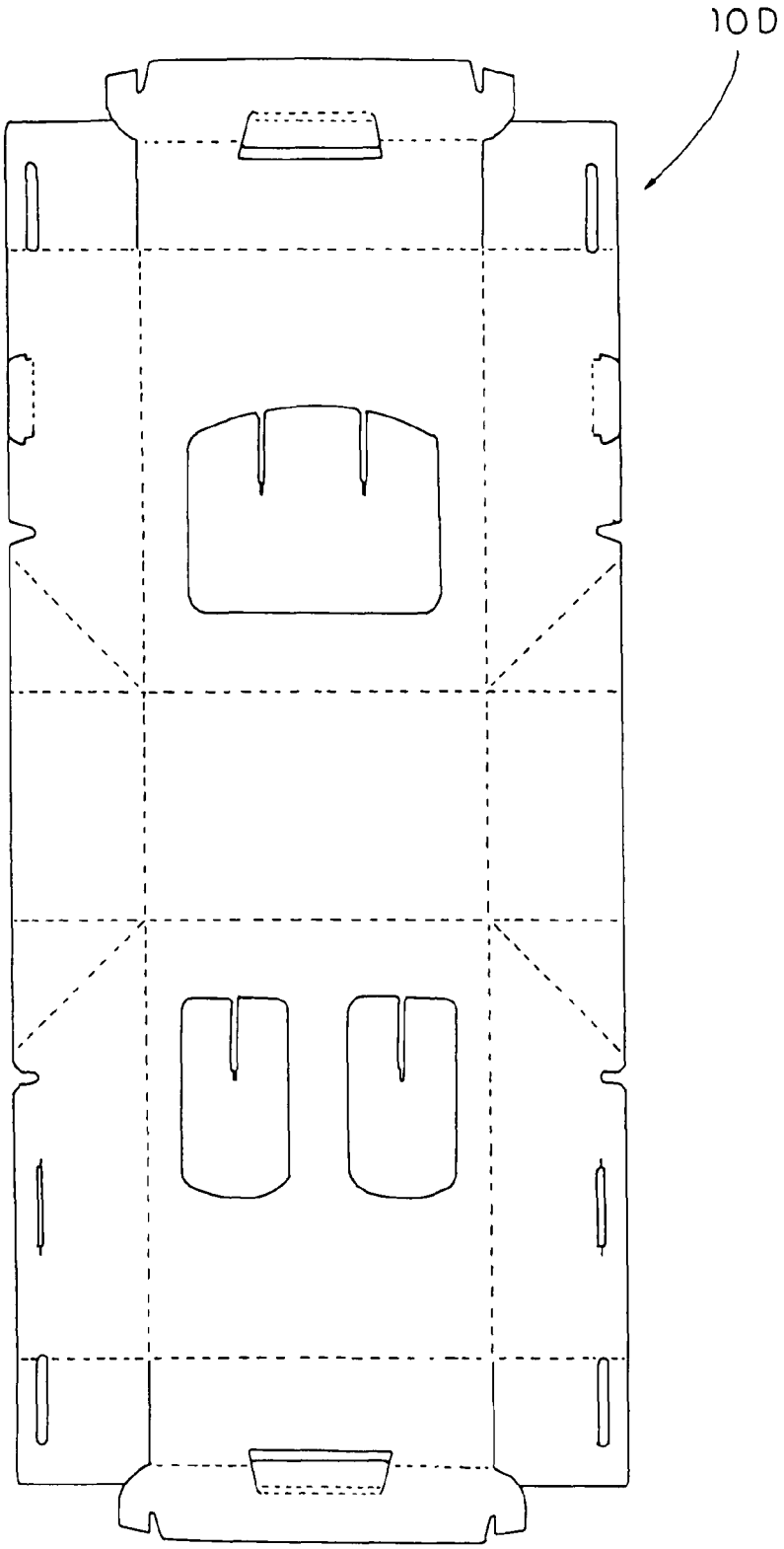
FIG. 10 is a schematic view of the carrying container according to the above preferred embodiment of the present invention, illustrating that the carrying container is adapted to carry six bottles in array.

Referring to FIG. 7 to FIG. 9 of the drawings, it is important to mention that the carrying container of the present invention can be configured to a one-bottle container body 10A (1×1) for containing one bottle, a two-bottle container body 10 (1×2) for containing two bottles, three-bottle container body 10B (1×3) for containing three bottles, and four-bottle container body 10C (1×4 or 2×2) for containing four bottles. The cut off from the panels for the four-bottle container body 10C are removed to form the partition by engaging the partitions together and place them between the bottles. In the four-bottle container body 10C, however, each bottle is positioned within the receiving cavity as one of a 2×2 array so that the present invention can easily be adjusted to be utilized in a wide variety of circumstances. As shown in FIG. 10, the six-bottle container body 10D (2×3) is especially used to carry 6 bottles of champagne with the weight up to 10 lb and above, in which each bottle of champagne is approximately 3.75 lb. It is worth to mention that for the six-bottle container body 10D, 3 pieces of partitions are cut out from the front panel and the rear panel to form the cavity partition. According to the 72 hours of the hanging performance test at 68° F. and 72 RH (relative humidity), all the prototype testing sample (10, 10A, 10B, 10C, 10D) pass the testing without any failure which proves the present invention is a functional design. In addition, the present invention not only provides the function and strength of the structural principles of the carrying container but also demonstrates how to maximize the usage of the material by minimizing the material waste and eliminate the unnecessary gluing operation.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A carrying container for one or more bottles, comprising:

a container body made of a one-piece panel structure having a plurality of folding lines provided thereon, comprising:

a bottom wall;

a top wall;

a front wall integrally extended from a front peripheral edge of said top wall to a front peripheral edge of said bottom wall;

a rear wall, which is similar to said front wall, integrally extended from a rear peripheral edge of said top wall to a rear peripheral edge of said bottom wall;

two side walls extended from two sides peripheral edges of said front wall to two side peripheral edges of said bottom walls respectively to form a substantially cubic structure of said container and to define a receiving compartment within said top wall, said bottom wall, said front wall, said rear walls and said two side walls for holding said bottle in said receiving compartment, wherein said container body further has a plurality of front display openings spacedly formed on said front wall and corresponding rear display openings spacedly formed on said rear wall, wherein said each of said front display openings is aligned with said corresponding rear display opening for said bottles in said receiving compartment being seen through said front display openings and said rear display openings, wherein each of said sidewalls comprises first and second side panels integrally and foldably extended from said front and rear walls respectively, and at least two different first and second locking means for detachably interlocking said first side panel with said second side panel to form a rigid double wall structure for each of said sidewalls; and a plurality of rear partitioning flaps integrally and foldably extended from rear hinge portions of peripheral edges of said rear openings respectively, and a plurality of front partitioning flaps integrally and foldably extended from front hinge portions of peripheral edges of said front openings respectively, wherein each of said front and rear partitioning flaps is inwardly folded into said receiving compartment to divide said receiving compartment into a corresponding number of storage partitions, wherein said front and rear partitioning flaps are overlapped with each other for forming a double wall structure to strengthen partitioning between every two of said storage partitions and to enhance protection for each of said storage partitions from external impact; and a packaging reinforcing arrangement which comprises two reinforcing walls which are integrally extended from two side edges of said bottom wall to said two side walls respectively and are supported within said receiving compartment at a position that a front reinforcing edge and a rear reinforcing edge of each of said reinforcing walls are biasing against inner surfaces of said front and rear walls of said container body for effectively resisting an external impact force exerted from said front and rear walls of said container to said bottle, such that said two reinforcing walls substantially enhance a structural strength of a bottom portion of said container body and prevent collapse of said carrying container, wherein each of said first and second side panels has a slanted bottom edge in which when said first side panel is detachably interlocked with said second side panel, said slanted bottom edges are overlapped on an outer surface of said corresponding reinforcing wall, wherein each of said side walls further comprises first and second triangular panels, said first triangular panel being integrally extended between said slanted bottom edge of said first side panel to said front reinforcing edge of said corresponding reinforcing wall, wherein said second triangular panel is integrally extended between said slanted bottom edge of said second side panel to said rear reinforcing edge of said corresponding reinforcing wall at said corresponding side wall, such that said first and second triangular panels integrally link said first and second side panels with said reinforcing wall, wherein when said front and rear walls are upwardly folded from said bottom wall to form said receiving compartment, said first and second triangular panels are folded and overlapped on outer sides of said reinforcing walls to retain said reinforcing walls at a position that said front and rear reinforcing edges of said reinforcing walls bias against said front and rear walls of said container body, wherein said carrying container is folded to form a box structure in an adhesive-less manner and having a double wall structure for enhancing an overall load-sustaining ability of said carrying container.

2. The carrying container, as recited in claim 1, wherein said first locking means comprises a locking flap foldably provided at an outer side edge portion of each of said first side panels a through locking slot formed thereon at each of said second side panels to align with said corresponding locking flap, wherein said locking flap is detachably engaged with said locking slot so as to detachably lock said first side panel with said second side panel.

3. The carrying container, as recited in claim 2, wherein each of said second side panels further has two holding silts extended from two ends of said locking slots respectively, wherein said locking flap has a main locking portion and a contracted portion, having a width smaller than a width of said main locking portion, integrally extended from said front wall to define two L-shaped locking shoulders between said main locking portion and said contracted portion at two sides thereof respectively, wherein said L-shaped locking shoulders are fittedly and detachably engaged with said two holding slits respectively to reinforce said locking flap being detachably interlocked with said corresponding locking slot.

4. The carrying container, as recited in claim 3, wherein said second locking means has first and second interlocking slots indently formed on said first and second side panels at side edges thereof respectively, wherein said first and second interlocking slots are inter-engaged with each other to interlock said first and second side panels with each other so as to further enhance a secure engagement between said first and second side panels.

5. The carrying container, as recited in claim 1, further comprising a handling arrangement extended from said top wall of said container body to facilitate easy carrying, wherein said top wall comprises first and second top panels integrally extended from top edges of said front and rear walls respectively, wherein said handling arrangement comprises first and second holding flaps integrally extended from top edges of said first and said second top panels respectively for normally enclosing said receiving compartment and allowing a user to grip on said holding flaps so as to facilitate carrying of said container body in a convenient manner.

6. The carrying container, as recited in claim 3, further comprising a handling arrangement extended from said top wall of said container body to facilitate easy carrying, wherein said top wall comprises first and second top panels integrally extended from top edges of said front and rear walls respectively, wherein said handling arrangement comprises first and second holding flaps integrally extended from top edges of said first and said second top panels respectively for normally enclosing said receiving compartment and allowing a user to grip on said holding flaps so as to facilitate carrying of said container body in a convenient manner.

7. The carrying container, as recited in claim 4, further comprising a handling arrangement extended from said top wall of said container body to facilitate easy carrying, wherein said top wall comprises first and second top panels integrally extended from top edges of said front and rear walls respectively, wherein said handling arrangement comprises first and second holding flaps integrally extended from top edges of said first and said second top panels respectively for normally enclosing said receiving compartment and allowing a user to grip on said holding flaps so as to facilitate carrying of said container body in a convenient manner.

8. The carrying container, as recited in claim 5, wherein said handling arrangement further has a plurality of handling slots formed on said first and second holding flaps respectively, wherein each of said handling slots is aligned with each other and is elongated in shape for fitting a width of a user's hand.

9. The carrying container, as recited in claim 6, wherein said handling arrangement further has a plurality of handling slots formed on said first and second holding flaps respectively, wherein each of said handling slots is aligned with each other and is elongated in shape for fitting a width of a user's hand.

10. The carrying container, as recited in claim 7, wherein said handling arrangement further has a plurality of handling slots formed on said first and second holding flaps respectively, wherein each of said handling slots is aligned with each other and is elongated in shape for fitting a width of a user's hand.

11. The carrying container, as recited in claim 8, wherein said handling arrangement further comprising two holder pads integrally extended from top edges of said handling slots of said first and second holding flaps respectively to foldably overlap with said second holding flap through said handling slot thereof so as to sandwich said second holding flap between said holder pads and said first holding flap so as to ensure said receiving compartment being enclosed when said carrying container is being carried.

12. The carrying container, as recited in claim 9, wherein said handling arrangement further comprising two holder pads integrally extended from top edges of said handling slots of said first and second holding flaps respectively to foldably overlap with said second holding flap through said handling slot thereof so as to sandwich said second holding flap between said holder pads and said first holding flap so as to ensure said receiving compartment being enclosed when said carrying container is being carried.

13. The carrying container, as recited in claim 10, wherein said handling arrangement further comprising two holder pads integrally extended from top edges of said handling slots of said first and second holding flaps respectively to foldably overlap with said second holding flap through said handling slot thereof so as to sandwich said second holding flap between said holder pads and said first holding flap so as to ensure said receiving compartment being enclosed when said carrying container is being carried.

14. The carrying container, as recited in claim 11, wherein said packaging reinforcing arrangement further comprises a weight support assembly extended from said top wall of said container body to facilitate even distribution of loading along said container body, wherein said weight support assembly comprises first and second hanging flaps integrally and foldably extended from top edges of said side walls respectively, and a plurality of hanging ears integrally and outwardly extended from two sides of each of said holding flaps, wherein each of said first and second hanging flaps comprises two flap panels integrally and upwardly extended from top edges of said first and second side panels of said corresponding side wall respectively, wherein each of said flap panels has an elongated weight loading slot formed thereon and arranged when said flap panels are overlapped with each other, said weight loading slots are aligned with each other, wherein each of said hanging ears has a corresponding number of V-shaped supporting notch downwardly extended from a top edge of said hanging ear, wherein said hanging ears pass through said weight loading slots to detachably engage said supporting notches with said weight loading slots of said corresponding hanging flap, wherein a distance between said two supporting notches is the same as a distance between said two side walls of said container body for evenly distributing a weight of said loading to said side walls through said handling arrangement.

15. The carrying container, as recited in claim 12, wherein said packaging reinforcing arrangement further comprises a weight support assembly extended from said top wall of said container body to facilitate even distribution of loading along said container body, wherein said weight support assembly comprises first and second hanging flaps integrally and foldably extended from top edges of said side walls respectively, and a plurality of hanging ears integrally and outwardly extended from two sides of each of said holding flaps, wherein each of said first and second hanging flaps comprises two flap panels integrally and upwardly extended from top edges of said first and second side panels of said corresponding side wall respectively, wherein each of said flap panels has an elongated weight loading slot formed thereon and arranged when said flap panels are overlapped with each other, said weight loading slots are aligned with each other, wherein each of said hanging ears has a corresponding number of V-shaped supporting notch downwardly extended from a top edge of said hanging ear, wherein said hanging ears pass through said weight loading slots to detachably engage said supporting notches with said weight loading slots of said corresponding hanging flap, wherein a distance between said two supporting notches is the same as a distance between said two side walls of said container body for evenly distributing a weight of said loading to said side walls through said handling arrangement.

16. The carrying container, as recited in claim 13, wherein said packaging reinforcing arrangement further comprises a weight support assembly extended from said top wall of said container body to facilitate even distribution of loading along said container body, wherein said weight support assembly comprises first and second hanging flaps integrally and foldably extended from top edges of said side walls respectively, and a plurality of hanging ears integrally and outwardly extended from two sides of each of said holding flaps, wherein each of said first and second hanging flaps comprises two flap panels integrally and upwardly extended from top edges of said first and second side panels of said corresponding side wall respectively, wherein each of said flap panels has an elongated weight loading slot formed thereon and arranged when said flap panels are overlapped with each other, said weight loading slots are aligned with each other, wherein each of said hanging ears has a corresponding number of V-shaped supporting notch downwardly extended from a top edge of said hanging ear, wherein said hanging ears pass through said weight loading slots to detachably engage said supporting notches with said weight loading slots of said corresponding hanging flap, wherein a distance between said two supporting notches is the same as a distance between said two side walls of said container body for evenly distributing a weight of said loading to said side walls through said handling arrangement.

* * * * *